United States Patent [19]

Ringel et al.

[11] Patent Number: 4,651,618

[45] Date of Patent: Mar. 24, 1987

[54] PROCESS FOR THE INTRODUCTION OF A CHARGE INTO A PROJECTILE CASING

[75] Inventors: Konrad Ringel, Leinburg; Wolfgang Degen, Altdorf, both of Fed. Rep. of Germany

[73] Assignee: Diehl GmbH & Co., Fed. Rep. of Germany

[21] Appl. No.: 715,505

[22] Filed: Mar. 25, 1985

[30] Foreign Application Priority Data

Apr. 25, 1984 [DE] Fed. Rep. of Germany ..... 3415389

[51] Int. Cl.[4] ..... F42B 33/02; C06B 21/00

[52] U.S. Cl. ..... 86/20.14; 86/20 R; 86/29; 86/30; 86/32; 86/20.1; 264/3.1

[58] Field of Search ..... 86/20 C, 29, 21, 25, 86/26, 27, 20 A, 30, 20 B, 31, 32, 33; 102/307, 476; 264/3 R

[56] References Cited

U.S. PATENT DOCUMENTS

| | | | |
|---|---|---|---|
| 2,784,638 | 3/1957 | Diels et al. | 86/20 B |
| 3,907,947 | 9/1975 | Neuhaus et al. | 86/1 R |
| 3,924,510 | 12/1975 | Strunk et al. | 86/1 R |
| 3,983,820 | 10/1976 | Crepin | 102/517 |
| 4,014,963 | 3/1977 | Gawlick et al. | 86/20 R |
| 4,208,945 | 6/1980 | Davegardh et al. | 86/20 R |
| 4,357,856 | 11/1982 | Wood et al. | 102/440 |
| 4,450,768 | 5/1984 | Bell | 86/20 R |
| 4,455,914 | 6/1984 | Christmann et al. | 86/20 B |
| 4,495,867 | 1/1985 | Mitchell, Jr. et al. | 102/275.4 |

*Primary Examiner*—Stephen J. Lechert, Jr.
*Assistant Examiner*—Howard J. Locker
*Attorney, Agent, or Firm*—Scully, Scott, Murphy & Presser

[57] ABSTRACT

A process for the introduction of a charge into a projectile casing, in which the charge is initially rough-pressed or compacted externally of the projectile casing, thereafter inserted into the projectile casing, and subsequently finish-compacted. Subsequent to the rough-pressing of the charge, the charge is brought down to a temperature which is lower than that of the projectile casing, and wherein the charge is introduced into the projectile casing prior to equilibrating the temperature difference.

3 Claims, 5 Drawing Figures

PROCESS FOR THE INTRODUCTION OF A CHARGE INTO A PROJECTILE CASING

BACKGROUND OF THE INVENTION

1. Field of the Invention

The present invention relates to a process for the introduction of a charge into a projectile casing, in which the charge is initially rough-pressed or compacted externally of the projectile casing, thereafter inserted into the projectile casing, and subsequently finish-compacted.

2. Discussion of the Prior Art

A process of that type is described in the disclosure of German Laid-Open Patent Application No. 31 07 788.

During the compressing of active charges possessing a high density, suitably high compressive pressures must be applied to the charge. It has been ascertained that during the compressing of elongated charges, the compaction in the region of the charge which is distant from the pressing die is lower than that in the region which is closer to the pressing die. This phenomenon can be traced back to the internal frictional resistance of the material of the explosive charge. Such non-uniformly or irregularly compacted charges will adversely influence the functional success and reliability of the explosive charge.

SUMMARY OF THE INVENTION

Accordingly, it is an object of the present invention to provide a process of the above-mentioned type, through the intermediary of which there can be obtained a charge which is compacted to a uniform degree within the projectile casing.

Inventively, the foregoing object is achieved pursuant to a process of the above-mentioned type in that, subsequent to the rough-pressing or compacting of the charge, the charge is brought down to a temperature which is lower than that of the projectile casing, and wherein the charge is introduced into the projectile casing prior to equilibrating the temperature difference. Due to the temperature difference between the projectile casing and the charge there is achieved that the volume of the rough-pressed charge becomes smaller than the volume of the projectile casing which is provided for its receipt. During temperature equilibration which is implemented subsequent to the introduction of the charge into the projectile casing, there is inherently produced an internal stressing of the charge within the projectile casing. As a consequence, the charge can also be compacted uniformly in such regions which could not be compacted in the same manner through mechanical compressing alone.

Hereby, in that the projectile casing and the rough-pressed charge are brought to different temperatures prior to their being assembled, in view of the expansion or shrinkage which is encountered therewith, there is rendered easier the insertion of the charge into projectile casing.

Pursuant to a preferred embodiment of the invention, the charge is already finish-pressed or compacted subsequent to insertion into the projectile casing but prior to the equilibrating of the pressure difference. Preferably, in accordance therewith, the charge is fixed in position within the projectile casing before the equalizing or compensating of the temperature difference. In that manner is there achieved that during the equilibrating of the temperature difference, the charge is already mechanically fixed in position within the projectile casing, so that the expansion or shrinkage forces will essentially completely exert themselves on the compacting of the charge.

According to one embodiment of the invention, the projectile casing is allowed to remain at the surrounding or ambient temperature, and the charge is cooled down relative to the temperature of the casing. As a result, there is eliminated any danger of the heating up of the charge because of a preheated projectile casing.

BRIEF DESCRIPTION OF THE DRAWINGS

Reference may be now had to the following detailed description of exemplary process steps, taken in conjunction with the accompanying drawings; in which.

DETAILED DESCRIPTION

Figure 1:
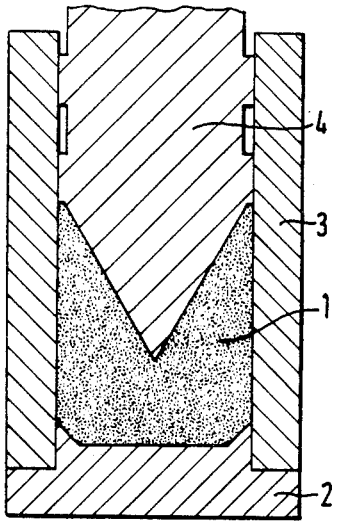
FIG. 1 illustrates the rough-pressing of the charge prior to insertion into a projectile casing.

Explosive charge material 1 is filled into a pressing die or worktool casing 3 which is positioned on a lower die section 2. Thereafter an upper die section 4 is pressed against the lower die section 2. As a result, there is produced a preform 5 whose volume can still be slightly greater than the internal volume of a projectile casing 6 with an insert 7 (referring to FIG. 5).

Irregularities in the compaction of the explosive charge material 1 are not of any disturbing significance within the preform 5.

Figure 2:
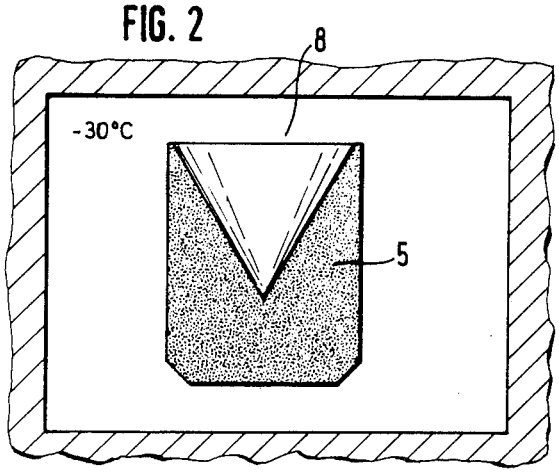
FIG. 2 illustrates the subcooling of the charge.
Figure 3:
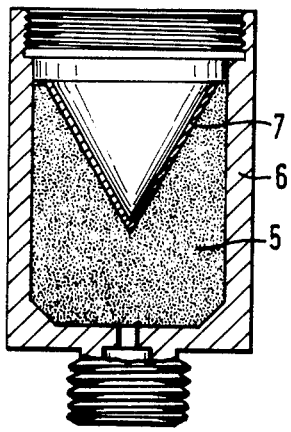
FIG. 3 illustrates the insertion of the charge into projectile casing.

The preform 5 is cooled down in a cooling chamber 8 to a temperature of about −30° C. (referring to FIG. 2). This will cause the preform to shrink. Thereafter the shrunken preform 5 is inserted into the projectile casing 6 and the insert 7 is applied on the preform 5 (referring to FIG. 3). The projectile casing 6 and the insert 7 both are at ambient temperature.

Figure 4:
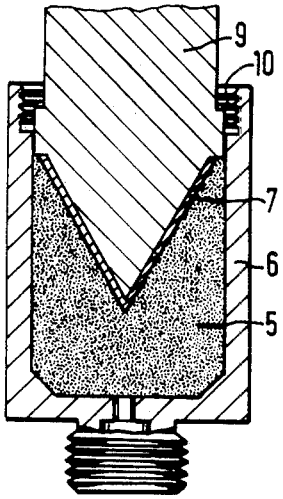
FIG. 4 illustrates the finish compacting of the charge within the projectile casing.

Immediately thereafter, through the action of a further pressure die 9, the insert 7 is pressed against the still subcooled preform 5, in view of which the latter is then finish-compacted (referring to FIG. 4).

Figure 5:
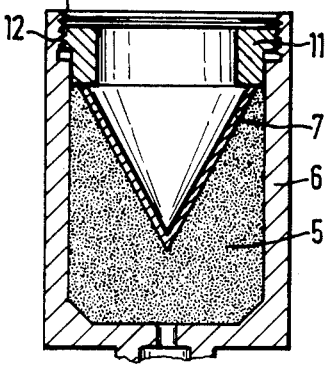
FIG. 5 illustrates the positional fixing of the charge within the projectile casing.

Subsequently, a retaining ring having an external screw thread 12 thereon is screwed into an internal screw thread 10 on the projectile casing 6. The retaining ring 11 presses the insert 7 against the still subcooled preform 5 (FIG. 5). As a result, the preform 5 is fixedly positioned between the projectile casing 6 and the insert 7.

Subsequently thereto, the preform 5 which is formed of an explosive charge compound 1 is warmed up to the ambient temperature of the projectile casing and insert 7. The thermal expansion which is connected therewith leads to a uniform compacting of the explosive charge compound 1 of the preform 5 which is in addition to the finish compacting. As a final result, all regions of the explosive charge compound 1 will thereby be compacted to a uniformly intensive measure.

Through the selection of the expansion or shrinkage which is dependent upon the temperature difference, and the tolerance between the projectile casing 6 and the rough-pressed preform 5, there can be determined the extent of the additional compaction.

The invention is not limited to the above-described embodiment. Thus, it is also possible to contemplate that the projectile casing 6 can be either additionally or exclusively preheated. The invention can also be practiced, when in lieu of the described unitary rough-pressed charge, there are introduced two or more rough-pressed or compacted charge portions into the projectile casing 6.

What is claimed is:

1. A process for the insertion of a charge into a projectile casing, comprising:

rough-pressing the charge externally of the projectile casing into a predetermined volume;

lowering the temperature of the charge subsequent to the rough-pressing of the charge to a temperature lower than that of the projectile casing thereby causing said rough-pressed charge to shrink to a volume lower than said predetermined volume;

inserting the subcooled charge into the projectile casing while there is a temperature difference between the charge and casing;

clamping the subcooled charge in a fixed position within the projectile casing; and equilibrating the temperature difference between the charge and casing causing the volume of said charge to increase thereby uniformly compacting said charge within said casing.

2. A process as claimed in claim 1, comprising maintaining the projectile casing at ambient temperature, and cooling the charge down relative to the temperature of said casing.

3. A process as claimed in claim 1, comprising cooling the charge to a temperature of approximately −30° C.

* * * * *